United States Patent [19]

Yoneyama et al.

[11] 4,144,069

[45] Mar. 13, 1979

[54] METHOD OF IMAGE FORMATION

[75] Inventors: Masakazu Yoneyama; Noriyuki Inoue; Nobuo Tsuji; Kimitaka Kameoka, all of Minami-ashigara, Japan

[73] Assignee: Fuji Photo Film Co., Ltd., Minami-ashigara, Japan

[21] Appl. No.: 775,682

[22] Filed: Mar. 8, 1977

[30] Foreign Application Priority Data

Mar. 8, 1976 [JP] Japan ..... 51-24783

[51] Int. Cl.[2] ..... G03C 5/24; G03C 5/30; G03C 1/06; G03C 1/28

[52] U.S. Cl. ..... 96/63; 96/95; 96/107; 96/66 R

[58] Field of Search ..... 96/63, 66, 95, 66.3, 96/114, 107

[56] References Cited

U.S. PATENT DOCUMENTS

| | | | |
|---|---|---|---|
| 2,441,389 | 5/1948 | Blake | 96/107 |
| 3,052,544 | 9/1962 | Dersch | 96/107 |
| 3,062,647 | 11/1962 | Herz | 96/107 |
| 3,294,540 | 12/1966 | Goffe | 96/114 |
| 3,518,085 | 6/1970 | Milton et al. | 96/66.3 |
| 3,617,284 | 11/1971 | DeMunck et al. | 96/66 R |

*Primary Examiner*—Mary F. Kelley
*Attorney, Agent, or Firm*—Sughrue, Rothwell, Mion, Zinn and Macpeak

[57] ABSTRACT

An image forming method comprising development processing a silver halide photographic material in the presence of at least one block copolymer represented by the following general formula (I):

$$Y[(CH_2CH_2CH_2CH_2O)_m-(CH_2CH_2O)_n-R]_x \quad (I)$$

and/or the general formula (II):

$$HO(CH_2CH_2O)_a(CH_2CH_2CH_2CH_2O)_b(CH_2CH_2O)_cH \quad (II)$$

wherein Y represents an organic residue of x valence; R represents a hydrogen atom or an alkyl group containing 1 to 18 carbon atoms; m is an integer of from 5 to 50; n is an integer of from 10 to 100; b is an integer of from 8 to 50; a + e ranges from 5 to 100; and the polyoxyethylene moieties therein comprise about 10 to about 70% by weight of the total weight of the compound; and x represents an integer of from 1 to 3.

11 Claims, No Drawings

METHOD OF IMAGE FORMATION

BACKGROUND OF THE INVENTION

1. Field of the Invention

This invention relates to a method of image formation using silver halide photographic materials and particularly to an improvement of adaptability to the developing agent in image formation based on silver halide lithographic type photographic materials.

2. Description of the Prior Art

Lithographic type (hereinafter, lith-type) photographic materials, comprising silver halide photographic emulsions having a very high contrast characteristic, are processed with a special type of extremely high contrast developer (hereinafter referred to as a lith-type developer) to provide a very contrasty image comprising half-tone dots and lines, and are used as photographic originals for printing plates.

A lith-type developer which is sometimes referred to as infectious developer from the mechanism of development involved can be supplied to the ultimate user in two different forms, i.e., either in a powder form in which a preliminary prepared powder is dissolved in water prior to use, or in a liquid form in which a concentrated solution is appropriately diluted for processing. Both types contain a dihydroxybenzene compound as a principal developing agent, an aldehyde-alkali metal bisulfite adduct, a small amount of a sulfite salt, etc.

In general, the powder type utilizes sodium carbonate as an alkaline material, while, on the other hand, the liquid type uses potassium carbonate as an alkaline material. Such selections are based on the fact that potassium carbonate is better suited for the liquid form because of its higher solubility.

Accordingly, these two types of developers have a different ionic strength in the final working solution, naturally causing different developing capabilities for the same photographic material.

For example, where one designes a certain type of photographic lith material so as to have a pre-determined sensitivity (photographic speed) when processed with a liquid type lith developer, the resulting film will exhibit a speed which is almost two times higher when such is processed with a powder type lith developer, and vice versa. Further, a lith film, which has been designed to exhibit a good dot reproducing capability when processed with a liquid type developer, will often exhibit a poor dot quality performance when a powder type developer is used, and vice versa.

On the other hand, a lith-type photographic material must be capable of being subjected to a mass scale, rapid processing; in other words, either mannual processing at a temperature below about 20° C. or a rapid processing using an automatic processor at a temperature not less than about 25° C. should desirably provide an image with a good dot quality together with a constant sensitivity (photographic speed).

Further, a photographic lith film should essentially not only provide an image of acceptable dot quality with a constant photographic speed unaffected by fluctuations in the composition or in the temperature of the developer, but also exhibit a desirable developing speed as well as an appropriate half-tone scale. (See Japanese Patent Application 64437/1974, and J. A. C. Yule, Principles of Color Reproduction, pp. 90 to 92, John Wiley & Sons Inc., (1967).)

To satisfy these requirements the effects of various compounds have been extensively investigated which are added to photographic emulsions or to processing agents.

As an example, a number of patents such as U.S. Pat. Nos. 3,294,540 and 3,471,297, British Pat. No. 1,107,022, Japanese Patent Publication 8586/1965, etc., disclose that polyoxyethylene compounds added to a silver halide emulsion layer can increase the image contrast and also improve dot quality.

However, it has still remained quite difficult to maintain the chief photographic characteristics (e.g., sensitivity (photographic speed), dot quality, half-tone scale, etc.) substantially unchanged with development under different conditions (e.g., with developers of different compositions, particularly of different ionic strengths or at different temperatures). Thus, when the process conditions differ, the exposure conditions must be correspondingly adjusted, or alternatively a series of lith films must be stocked, each of which has a different content of certain additives. This complexity, of course, gives rise to disadvantages and inexpediences in daily processing practice and on the manufacture of photographic materials.

SUMMARY OF THE INVENTION

A principal object of the present invention is to provide an image forming method in which substantially a constant sensitivity as well as a constant dot quality is achieved with various developer compositions, particularly of different ionic strengths.

A second object is to provide an image forming method which uses a lith-type photographic material and which is little influenced by changes in the developer temperature and the developer composition.

A third object of the present invention is to provide photographic lith films which exhibit a constant photographic speed and an acceptable dot quality over a wide range of developer compositions (particularly ionic strength) and developing temperatures.

A fourth object is to provide a lith-type photographic material which is little influenced by changes in the developer composition and temperature, exhibiting a good half-tone scale performance in a stable manner.

A fifth object of the present invention is to provide a silver halide photographic material which has desirable developing characteristics during development as such progresses.

These objects of the present invention are achieved by developing a silver halide photographic material in the presence of a block copolymer comprising polyoxytetramethylene units and polyoxyethylene units represented by the following general formula (1):

$$Y[(CH_2CH_2CH_2CH_2O)_m-(CH_2CH_2O)_n-R]_x \quad (I)$$

and/or the following general formula (II):

$$HO(CH_2CH_2O)_a(CH_2CH_2CH_2CH_2O)_b(CH_2CH_2O)_cH \quad (II)$$

wherein Y represents an organic residue of x valence; R represents a hydrogen atom or an alkyl group containing 1 to 18 carbon atoms; m is an integer of from 5 to 50; n is an integer of from 10 to 100; b is an integer of from 8 to 50; a + c ranges from 5 to 100; and the polyoxyethylene moieties therein comprise about 10 to about 70% by weight of the total weight of the compound; and x represents an integer of from 1 to 3.

DETAILED DESCRIPTION OF THE INVENTION

In the formulae (I) and (II), Y represents an organic group of a valence x, and particularly those residual groups which result by eliminating x active hydrogen atoms from organic compounds containing elements selected from the group consisting of C, H, O, N and S, and at the same time containing a number of active hydrogen atoms greater than x where x is equal to 1, 2 or 3. Examples include residues of monohydroxy compounds represented by the formula:

$R_1OH$ wherein $R_1$ is an alkyl group having 1 to 20 carbon atoms, an aryl group having 6 to 20 carbon atoms, an aralkyl group having 1 to 20 carbon atoms in the alkyl moiety thereof and 6 to 20 carbon atoms in the aryl moiety thereof; residues of polyhydroxy compounds having the formula:

$R_1(OH)_n$ wherein $R_1$ is the same as described above and n is 2 or 3; residues of monocarboxylic acids having the formula:

$R_1COOH$ wherein $R_1$ is as described above; residues of polycarboxylic acids having the formula:

$R_1(COOH)_n$ wherein $R_1$ and n are as described above; residues of thiol compounds having the formula:

$R_1SH$ wherein $R_1$ is as described above; residues of amine compounds having the formula:

$R_1NH_2$ wherein $R_1$ is as described above; and the like. Specific examples include, e.g., $C_6H_{13}O-$, $C_{12}H_{25}O-$, $C_{18}H_{37}O(CH_2CH_2O)_{10}-$, $C_{11}H_{23}COO-$,

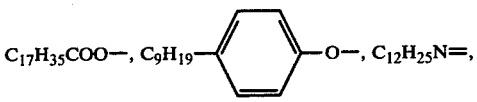

$C_{17}H_{35}COO-$, $C_9H_{19}-$ ⟨benzene⟩ $-O-$, $C_{12}H_{25}N=$,

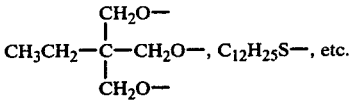

$CH_3CH_2-C(CH_2O-)_3$, $CH_2O-$, $C_{12}H_{25}S-$, etc.

R represents a hydrogen atom or an alkyl group containing 1 to 18 carbon atoms, preferably 1 to 3 carbon atoms, m is an integer from 5 to 50, n is an integer from 10 to 100, b is an integer from 8 to 50, the sum of a and c is from 5 to 100, and at the same time the polyoxyethylene portion must comprise from about 10 to about 70% by weight of the block polymer.

Particularly preferable cases are where m is an integer of from 10 to 40, n is an integer of from 15 to 70, b is an integer of from 14 to 40, the sum of a and c is an integer of from 5 to 70, and that the polyoxyethylene portion comprises 20 to 60% by weight of the block copolymer.

A suitable molecular weight range for the block copolymer represented by the general formulae (I) and (II) is about 800 to 7,000, preferably 1,200 to 5,300.

Some specific examples of the block copolymer represented by the general formulae (I) and (II) are given below.

Typical block copolymers represented by the general formula (I) wherein x equals 1:

| Compound No. | Organic Residual Group Represented by Y | m | n | R |
|---|---|---|---|---|
| 1 | $C_{12}H_{25}O-$ | 10 | 20 | H |
| 2 | $C_{12}H_{25}O-$ | 15 | 30 | H |
| 3 | $C_{12}H_{25}O(CH_2CH_2O)_{10}-$ | 20 | 20 | H |
| 4 | $C_{12}H_{25}O(CH_2CH_2O)_{10}-$ | 30 | 30 | H |
| 5 | $C_{11}H_{23}COO-$ | 5 | 10 | H |
| 6 | $C_{11}H_{23}COO-$ | 10 | 20 | H |
| 7 | $C_{11}H_{23}COO-$ | 15 | 30 | H |
| 8 | $C_{11}H_{23}COO-$ | 30 | 50 | H |
| 9 | $C_{17}H_{33}COO-$ | 14 | 30 | H |
| 10 | $C_{17}H_{33}COO-$ | 30 | 50 | H |
| 11 | $C_{17}H_{33}COO-$ | 40 | 100 | H |
| 12 | $C_9H_{19}-$ ⟨benzene⟩ $-O-$ | 5 | 10 | H |
| 13 | $C_9H_{19}-$ ⟨benzene⟩ $-O(CH_2CH_2O)_{10}-$ | 20 | 30 | H |
| 14 | $C_{12}H_{25}O(CH_2CH_2O)_{10}-$ | 15 | 20 | $C_2H_5$ |

Typical block copolymers represented by the general formula (II):

| Compound No. | b | a + c |
|---|---|---|
| 15 | 16 | 15 |
| 16 | 16 | 20 |
| 17 | 16 | 25 |
| 18 | 16 | 30 |
| 19 | 16 | 40 |
| 20 | 23 | 20 |
| 21 | 23 | 30 |
| 22 | 31 | 30 |
| 23 | 31 | 50 |
| 24 | 45 | 30 |
| 25 | 45 | 70 |
| 26 | 50 | 60 |
| 27 | 50 | 70 |
| 28 | 10 | 10 |
| 29 | 10 | 20 |
| 30 | 14 | 6 |
| 31 | 14 | 16 |
| 32 | 14 | 35 |
| 33 | 20 | 8 |
| 34 | 20 | 22 |
| 35 | 20 | 50 |
| 36 | 27 | 30 |

Polyoxytetramethylene can be synthesized using various methods including, for example, those described in Japanese Patent Applications (OPI) 44297/1975 and 102698/1975 (corresponding to German Patent Application (OLS) 2,401,855).

Further, polyoxytetramethylene polymers are commercially available, one example of such a commercial product being available under the trade name "TERACOL" produced by E. I. DuPont de Nemours & Co., U.S.A.

The block copolymer represented by the general formula (II) can be easily obtained by an addition polymerization of ethylene oxide onto the polyoxytetramethylene polymer, i.e., ethylene oxide is bubbled into polyoxytetramethylene polymer in succession in the presence of an alkali catalyst (e.g., NaOH, KOH) at a temperature of about 90° to 120° C. The sum of a and c of the general formula (II) can be easily calculated based on the increased weights of the products.

Descriptions are set forth below as to the desirable amount of such a block copolymer to be used and how the copolymer should be introduced to the developing system.

The block copolymer can be present in a lith-type photographic material or in a lith developer, but incorporation in a lith-type photographic material is preferred.

The material should preferably be incorporated into the photographic emulsion layer and/or into the layers contiguous to the emulsion layer, with incorporation into the photographic emulsion layer being more preferable.

The copolymer should preferably be added into the hydrophilic colloid coating mixture, which will then be coated to form the photographic emulsion layer and/or a contiguous layer thereto.

The amount to be added should preferably range from about 0.0005 to about 2 g per mol of silver, and more preferably from 0.02 to 0.5 g per mol of silver.

Silver halide emulsions which can be used for the present invention can be prepared using any of the methods described in, for example, C. E. K. Mees & T. H. James, The Theory of the Photographic Process, 3rd Edition, pp. 31 to 43, Macmillan Co., New York (1967), P. Grafkides, Chimie Photographique, 2nd Edition, pp. 251 to 308, Paul Montel Co., Paris (1957), etc., including the neutral, acidic, single jet, double jet and controlled double jet methods, etc.

Preferred silver halides are silver iodochloride or silver iodobromochloride which should contain at least about 60 mol% silver chloride (more preferably more than 75 mol%), and from 0 to 5 mol% silver iodide, the remainder being silver bromide. Although the present invention does not have any particular limitations on the shape, the habit and the size distribution of silver halide grains, grains not larger than about 0.7 micron in diameter are preferred.

The sensitivity (photographic speed) of silver halide emulsion can be increased, without any growth of the silver halide grains, by the use of certain gold compounds, such as chloroaurate salts, gold trichloride, etc., salts of noble metals, such as rhodium, iridium, etc., sulfur compounds capable of reacting with the silver halide to form silver sulfide, and some reducing compounds including stannous salts, organic amines, etc.

Suitable binders for dispersing the silver halide include gelatin, modified gelatins, gelatin derivatives and synthetic hydrophilic polymers.

The silver halide emulsion layer or other associated layers can also contain, in the form of a latex, homo- and copolymers comprising alkyl acrylates, alkyl methacrylates, acrylic acid, glycidyl acrylates, etc., for the purpose of improving the dimensional stability of the resulting photographic material, or improving the physical properties of the coated film. Such techniques are disclosed in a number of patents including U.S. Pat. Nos. 3,411,911, 3,411,912, 3,142,568, 3,325,286, 3,547,650, Japanese Patent Publication 5331/1970, etc.

Photographic emulsions used for the present invention can also contain anti-fogging agents well known in the art and described in Japanese Patent Publications 81024/1974, 6306/1975, and 19429/1975, and U.S. Pat. No. 3,850,639, including various heterocyclic compounds, mercapto compounds and mercury-containing compounds, such as 4-hydroxy-6-methyl-1,3,3a,7-tetrazaindene, 3-methylbenzothiazole, 1-phenyl-5-mercaptotetrazole, etc.

The silver halide lith-type emulsions for use in the present invention can be ortho- or panchromatically spectrally sensitized or supersensitized with one or more cyanine dyes (cyanine, merocyanine, carbocyanine, etc.) or in combination with styryl or other suitable dyes. Among the various sensitizing dyes, those described in Japanese Patent Applications 20623/1975 and 93833/1975, and in U.S. Pat. No. 3,567,458 are particularly suitable.

Hardeners which can be used and on which the present invention also does not impose any particular limitation include aldehyde or ketone compounds, compounds containing reactive halogen atoms such as 2-hydroxy-4,6-dichloro-1,3,5-triazine, reactive olefinic compounds, N-methylol compounds, aziridine compounds, carbodiimide compounds, etc.

Further, the photographic emulsions for use in the present invention can contain surface active agents as coating aids or in order to improve the photographic properties in addition to the block copolymer which characterizes the present invention.

Suitable surfactive agents include natural surfactants such as saponin, nonionic surfactants such as alkylene oxides (e.g., those described in Japanese Patent Applications (OPI) 156423/1975 and 69124/1974), glycidols, etc.; anionic surfactants containing acidic groups such as carboxylic, sulfonic (those disclosed in, e.g., U.S. Pat. No. 3,415,649), phosphoric, sulfuric acid ester, phosphoric ester, etc., groups; and amphoteric surfactants containing amino acid, aminosulfonic acid, sulfonic or phosphoric acid ester of amino alcohol, etc., groups. Suitable development accelerators which can be used include those disclosed in the following patents: U.S. Pat. Nos. 3,288,612, 3,333,959, 3,345,175 and 3,708,303, British Pat. No. 1,098,748, and German Patents No. 1,141,531 and No. 1,183,784. As for other additives to the emulsion and manufacturing processes for the photographic material, reference can be made to Product Licensing Index, Vol. 92, pp. 107 to 110 (1971).

Lith-developers well suited for practicing the present invention basically comprise o- or p-dihydroxybenzene, an alkaline agent, a small amount of sulfide ion and a sulfide ion buffer. Lith-developers are described in detail in U.S. Pat. Nos. 3,622,330, 3,325,286, 3,158,483, 3,142,568 and 3,030,209.

The o- or p-dihydroxybenzene can be selected from those well known in the photographic art. Suitable compounds include hydroquinone, chlorohydroquinone, bromohydroquinone, isopropylhydroquinone, toluhydroquinone, methylhydroquinone, 2,3-dichlorohydroquinone, 2,5-dimethylhydroquinone, etc., among which hydroquinone is most preferred. These principal developing agents can be used individually or in combination. The concentration of the principal developing agent ranges from about 1 to about 100 g per liter of developer, and more preferably from 5 to 80 g per liter of developer.

The sulfide ion buffer is used in a concentration which effectively maintains the sulfide ion concentration substantially constant in the developer, suitable compounds being aldehyde-alkali metal bisulfide adducts, such as formaldehyde-$NaHSO_3$ adduct, ketone-alkali metal bisulfite adducts, such as acetone-$NaHSO_3$ adduct, or carbonyl bisulfiteamine condensates, such as Na-bis(2-hydroxyethyl)aminomethane sulfonate, etc. A suitable concentration for the sulfite ion buffer ranges from about 13 to about 130 g per liter of developer.

The concentration of sulfite ion in the developer used for the present invention can be controlled by adding an alkali metal sulfite such as $Na_2SO_3$. In general, the sulfite salt is employed in an amount not higher than about 5 g, and more preferably 3 g, per liter of developer, although, of course, more than about 5 g per liter can be used, if desired.

Developers should preferably contain development regulating agents, such as alkali metal halides (particularly, bromide salts, such as NaBr and KBr) in an amount of from about 0.01 to 10 g, more preferably from 0.1 to 5 g, per liter of developer.

In order to provide the developer with a pH of at least about 9 (particularly between 9.7 and 11.5) an alkaline agent, such as sodium or potassium carbonate is added to the developer. In contrast to the fact that conventional lith-type photographic materials containing development promoting or controlling agents behave differently with respect to photographic performance depending on the alkaline agent of the developer used as has been already pointed out, i.e., a developer containing sodium carbonate or a developer containing potassium carbonate, the photographic material prepared in accordance with the present invention is hardly influenced by the ionic strength of developer, thus, the material of the present invention can be processed with various types of developers of different ionic strengths to achieve substantially constant and acceptable photographic properties, with no limitations on the kind of alkaline agent used.

Further, developers for use in the present invention can contain, in addition to the above-described components, a pH buffer such as a water-soluble acid (e.g., acetic acid or boric acid), an alkali (e.g., sodium hydroxide), or a salt (e.g., sodium carbonate). Certain alkaline compounds not only make the developer alkaline, but also act as a pH buffer and a development controlling agent. Other components which can be added to the developer include a preservative, such as diethanol amine, ascorbic acid, and kojic acid, an anti-foggant such as benzotriazole, 1-phenyl-5-mercaptotetrazole, etc., and an organic solvent such as triethylene glycol, dimethylformamide, and methanol.

Since these components need only be present in the developing solution at the moment of processing, they do not need to be necessarily combined into a single mixture, but may comprise two or more separate mixtures which are mixed when the developer solution is used. For example, a first fraction containing the principal developing agent and a second fraction containing the alkaline agent, both in the form of a solution, may be appropriately diluted immediately prior to use.

In the present invention, it is self-evident that both types of developers, i.e., liquid or powder, will provide equivalently satisfactory photographic characteristics.

In practicing the present invention, the developing temperature should preferably range from about 20° to about 40° C., although, of course, temperatures outside this range can be used, if desired.

One particular advantage of the method of the present invention is that a substantially constant sensitivity together with a satisfactory dot quality can be obtained in a stable manner within the developing temperature range of from about 20° to about 40° C. A preferred development period ranges from about 10 to 250 seconds, and more preferably from 10 to 150 seconds, depending on the developing temperature employed.

Development can be performed manually or using an automatic processor. In using an automatic processor, any film transport methods can be employed including roller and belt conveyers, thus allowing the use of any types of automatic processing machines well known in the art. As for the formulation of processing solutions and development methods, reference can be made to the following patent specifications: U.S. Pat. Nos. 3,025,779, 3,078,024, 3,122,086, 3,149,551, 3,156,173, 3,224,356, 3,573,914, etc.

In order to obtain a photographic image, the photographic material is image-wise exposed in a conventional manner. Various light sources can be used including natural light (sunlight), a tungsten lamp, a fluorescent lamp, a mercury lamp, a xenon lamp, an arc, a carbon arc, a xenon flash, a cathode ray tube, a flying spot scanner, etc. A very wide range of exposure times can be used including ordinary camera exposure times ranging from about 1/1,000 to 1 second, or shorter than 1/1,000, i.e., a flash exposure ranging from about $10^{-4}$ to $10^{-6}$ second for a xenon flash or a cathode ray tube, and another range exceeding 1 second. Depending on practical requirements, the spectral range of light employed can be controlled using a color filter. Laser light can also be used for exposure. Exposure may also be accomplished using light emitted from phosphors excited by electron beams, X-rays, $\gamma$-rays, or $\alpha$-rays.

By practicing the present invention, a constant sensitivity and a satisfactory dot quality which does not vary due to changes in the ionic strength of the developer resulting from use of different alkaline agents can be achieved, and also always good photographic characteristics over a wide range of development temperatures and periods of time are assured.

In addition, in the present invention the addition of an onium salt and other development accelerating agents to the photographic material is quite effective, achieving good half-tone scale without any deterioration of dot quality.

It is a quite unexpected and a surprising fact that the block copolymer, characterizing the present invention and comprising the polyoxytetramethylene and polyoxyethylene compounds described above, have these various advantages described above over the similar copolymers comprising polyoxypropylene and polyoxyethylene, which are disclosed in U.S. Pat. No. 3,294,540. (The latter copolymers are commercially available under the trade name "Pluronics" produced by Wyandotte Chemical.)

This difference may be attributed to the differences in the chemical structures of the two groups of copolymers; compared with Pluronics, the block copolymers of the present invention are characterized by the lack of a methyl side chain paralleling the hydrophobic portion of the main chain, which fact probably results in a marked difference in the surface active nature, thus giving rise to a markedly amplified effect on the photographic chemical performance of the two groups of copolymers.

More detailed descriptions are given below for a better understanding of the present invention by reference to some specific examples of the present invention. Unless otherwise indicated herein, all parts, percentages, ratios and the like are by weight.

EXAMPLE 1

A silver halide photographic emulsion was prepared by gold- and sulfur-sensitization of a silver halide composition comprising 80 mol% of silver chloride, 19.5 mol% of silver bromide and 0.5 mol% of silver iodide. The average grain diameter was 0.35 micron.

625 g of this emulsion was weighed into each of 15 pots. A polyoxyethylene compound as shown in Table 1 below was added to each of the pots and further suitable amount of 3-carboxymethyl-5-[2-(3-ethylthiazolinylidene)ethylidene]-rhodanine as a spectral sensitizer, 4-hydroxy-1,3,3a,7-tetrazaindene as a stabilizer, mucochloric acid as a hardening agent and the polymer latex described in Manufacturing Example 3 of Japanese Patent Publication 5331/1970 (correspond- to U.S. Pat. No. 3,525,620) were added in this order. The resulting mixture was coated (5 g Ag/m$^2$) on a polyethylene terephthalate film support to form a photographic material.

The photographic material thus prepared was contact-exposed through the combination of a gray contact screen for positive use (150 lines/inch) and an optical step wedge with a step difference of 0.1 to a tungsten lamp for 10 seconds, and then developed with either of Developer (I) or (II) shown in Table 2 below for 3 minutes at 20° C. Fixing and washing were carried out in an ordinary manner.

After processing, the dot quality was evaluated by observing the 50% half-tone dots under a microscope with a degree of magnification of 100, and was rated in accordance with the following scale.

A: excellent
A': good
B: acceptable practically
C: inferior
D: poor

Separately, the sensitivity (photographic speed) was measured by eliminating the contact screen at exposure, processing in a similar manner and carrying out sensitometry. The sensitivity, which is defined by the reciprocal of the exposure amount required to obtain a density of 1.5, was expressed relative to that of Sample 8 processed with Developer (I) which was made 100.

-continued (P-2) designates $HO(CH_2CH_2O)_a(\underset{\underset{C_2H_5}{|}}{C}HCH_2O)_b(CH_2CH_2O)_cH$ wherein a + c equals 18, and b equals 20, (P-3) designates $HO(CH_2CH_2O)_a(\underset{\underset{CH_3}{|}}{C}HCH_2O)_b(CH_2CH_2O)_cH$ wherein a + c equals 18 and b equals 21, (P-4) designates $C_{12}H_{25}O(\underset{\underset{CH_3}{|}}{C}HCH_2O)_{19}(CH_2CH_2O)_{30}H$, respectively.

Compound A is outside the scope of the present invention since the polyoxyethylene unit exceeds 80% by weight of the total molecule, although the values of b and of a + c fall within the scope of the present invention.

Compounds 30 to 36 which are represented by the general formula (II) and compound 2 which is represented by the general formula (I) are all within the scope of the present invention.

TABLE 2

| | Developer Composition | |
|---|---|---|
| | Developer (I) | Developer (II) |
| Hydroquinone | 15 g | 15 g |
| Formaldehyde-$NaHSO_3$ Adduct | 50 g | 50 g |
| Sodium Carbonate | — | 80 g |
| Potassium Carbonate | 30 g | — |
| Sodium Sulfite | 2.5 g | 2.5 g |
| Potassium Bromide | 2.0 g | 2.0 g |
| Boric Acid | 5.0 g | 5.0 g |
| Sodium Hydroxide | 3.0 g | — |
| Triethylene Glycol | 40 g | — |
| EDTA (disodium salt) | 1.0 g | 1.0 g |
| Water to make | 1,000 cc | 1,000 cc |

As is evident from the results in Table 1, the sensitivities of Samples 6 to 12 and 14 containing polyoxyethylene Compounds 30–36 and 2 characteristic of the present invention are not influenced by the change of developer and show almost the same value. Further, the dot quality is excellent.

On the contrary, in the case where Compounds (P-3) and (P-4) were employed, the difference in sensitivity is rather large and the dot quality is not satisfactory.

TABLE 1

| | Polyoxyethylene Compound | | | | Relative Sensitivity (speed) | | Dot Quality | |
|---|---|---|---|---|---|---|---|---|
| Sample No. | Compound No. | Value of b (in General Formula II | Value of a+c (in General Formula II | Amount Added (g/AgX mol) | Developer I | Developer II | Developer I | Developer II |
| 1 | P-1 | — | — | 0.20 | 96 | 98 | B | B |
| 2 | P-2 | — | — | 0.16 | 100 | 98 | A' | B |
| 3 | P-3 | — | — | 0.07 | 98 | 150 | A | D |
| 4 | " | — | — | 0.10 | 80 | 102 | B | A |
| 5 | " | — | — | 0.14 | 57 | 85 | C | B |
| 6 | 30 | 14 | 6 | 0.20 | 98 | 97 | A | A |
| 7 | 31 | " | 16 | 0.18 | 97 | 99 | A | A |
| 8 | 32 | " | 35 | 0.15 | 100 | 100 | A | A |
| 9 | 33 | 20 | 8 | 0.23 | 96 | 98 | A | A |
| 10 | 34 | " | 22 | 0.21 | 102 | 100 | A | A |
| 11 | 35 | " | 50 | 0.17 | 103 | 102 | A | A |
| 12 | 36 | 27 | 30 | 0.24 | 101 | 99 | A | A |
| 13 | A | 12 | 80 | 0.10 | 104 | 105 | B | B |
| 14 | 2 | — | — | 0.15 | 103 | 107 | A | A |
| 15 | P-4 | — | — | 0.13 | 96 | 140 | A | D |

In Table 1:

(P-1) designates $HOCH_2CH_2O(CH_2CH_2O)_{50}$— 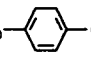 —$C_9H_{19}$,

When Compounds (P-1), (P-2) and (A) were used, the sensitivity remained substantially constant for the two developers, but the dot quality became inferior.

EXAMPLE 2

Sensitivity and dot quality were compared when samples prepared as described in Example 1 were developed with Developer (I) under three different development conditions; 3 minutes at 20° C.; 1 minute and 50 seconds at 25° C.; and 1 minute at 30° C. The results obtained are shown in Table 3 below.

TABLE 3

| Sample No. | Relative Sensitivity (photographic speed) 20° C. | 25° C. | 30° C. | Dot Quality 20° C. | 25° C. | 30° C. |
|---|---|---|---|---|---|---|
| 1 | 96 | 98 | 98 | B | B | B |
| 2 | 100 | 101 | 103 | A' | A' | B |
| 3 | 98 | 120 | 160 | A | C | D |
| 4 | 80 | 100 | 130 | B | A | C |
| 5 | 57 | 73 | 99 | C | B | A |
| 6 | 98 | 100 | 99 | A | A | A |
| 7 | 97 | 96 | 98 | A | A | A |
| 8 | 100 | 99 | 100 | A | A | A |
| 9 | 96 | 96 | 97 | A | A | A |
| 10 | 102 | 100 | 101 | A | A | A |
| 11 | 103 | 102 | 101 | A | A | A |
| 12 | 101 | 100 | 100 | A | A | A |
| 13 | 104 | 103 | 105 | B | B | B |
| 14 | 103 | 104 | 103 | A | A | A |
| 15 | 96 | 110 | 150 | A | B | D |

As the results in Table 3 clearly disclose, Sample Nos. 6–12 and 14 which contain polyoxyethylene compounds characterizing the present invention exhibit a substantially constant photographic speed over the development temperature range of from 20° to 30° C., and at the same time, half-tone images with good dot quality are obtained.

On the contrary, for the samples utilizing Compounds (P-3) and (P-4), the photographic speed as well as dot quality have a rather large dependency on development temperature, thus proving to be inferior to the samples of the present invention from a practical standpoint.

While the invention has been described in detail and with reference to specific embodiments thereof, it will be apparent to one skilled in the art that various changes and modifications can be made therein without departing from the spirit and scope thereof.

What is claimed is:

1. An image forming method comprising image-wise exposing and development processing a silver halide photographic material with at least one polyoxytetramethylene-containing block copolymer represented by the following general formula (I):

$$Y[CH_2CH_2CH_2CH_2O)_m—(CH_2CH_2O)_n—R]_x \quad (I)$$

and/or the general formula (II):

$$HO(CH_2CH_2O)_a(CH_2CH_2CH_2CH_2O)_b(CH_2CH_2O)_cH \quad (II)$$

present in the photographic material wherein Y represents the radical obtained upon eliminating x active hydrogens from an organic compound selected from the group consisting of monohydroxy compounds, polyhydroxy compounds, monocarboxylic acids, polycarboxylic acids, thiols and amines, wherein said monohydroxy compounds are represented by the formula $R_1OH$, said polyhydroxy compounds are represented by the formula $R_1(OH)_z$, said monocarboxylic acids are represented by the formula $R_1COOH$, said polycarboxylic acids are represented by the formula $R_1(COOH)_z$, said thiol compounds are represented by the formula $R_1SH$ and said amines are represented by the formula $R_1NH_2$, wherein $R_1$ is an alkyl group having 1 to 20 carbon atoms, an aryl group having 6 to 20 carbon atoms, an aralkyl group having 1 to 20 carbon atoms in the alkyl moiety and 6 to 20 carbon atoms in the aryl moiety, and z is 2 or 3; R represents a hydrogen atom or an alkyl group containing 1 to 18 carbon atoms; m is an integer of from 5 to 50; n is an integer of from 10 to 100; b is an integer of from 8 to 50; a + c ranges from 5 to 100; and the polyoxyethylene moieties therein comprise about 10 to about 70% by weight of the total weight of the copolymer; and x represents an integer of from 1 to 3.

2. The method of claim 1, wherein said block copolymer has the general formula (II).

3. The method of claim 1, wherein the amount of said copolymer represented by the general formulae (I) and (II) ranges from about 0.0005 to about 2 g per mol of silver in said silver halide photographic material.

4. The method of claim 1, wherein m is an integer of from 10 to 40, n is an integer of from 15 to 70, b is an integer of from 14 to 40, the sum of a and c is an integer of from 5 to 70 and said polyoxyethylene moieties contained therein comprise 20 to 60% by weight of said block copolymer.

5. The method of claim 1, wherein said organic residue Y is one member selected from the group consisting of $R_1'O—$,

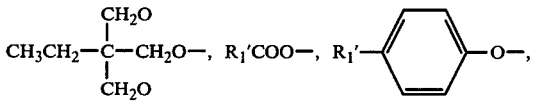

$R_1'S—$ or $R_1'N=$, wherein $R_1'$ is an alkyl group having 1 to 18 carbon atoms and $R_3$ is a hydrogen atom, an alkyl group having 1 to 5 carbon atoms or a $CH_2O—$ radical.

6. The method of claim 5, wherein said alkyl moiety $R_1'$ has 6 to 12 carbon atoms.

7. The method of claim 1, wherein said organic residue Y is $C_6H_{13}O—$, $C_{12}H_{25}O—$, $C_{18}H_{37}O(CH_2CH_2O)_{10}—$, $C_{11}H_{23}COO—$,

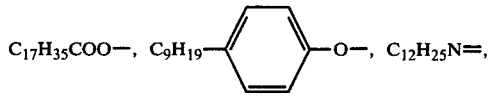

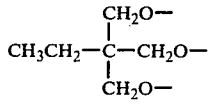

or $C_{12}H_{25}S—$.

8. A silver halide photographic material comprising at least one silver halide emulsion layer on a support, wherein said silver halide comprises about 60 to about 95 mol% silver chloride, about 5 to about 40 mol% silver bromide and 0 to about 5 mol% silver iodide, and said silver halide emulsion layer and/or an adjacent layer thereto contain at least one polyoxytetramethylene-containing block copolymer represented by the following general formula (I):

$$Y[CH_2CH_2CH_2CH_2O)_m—(CH_2CH_2O)_n—R]_x \quad (I)$$

and/or the general formula (II):

$$HO(CH_2CH_2O)_a(CH_2CH_2CH_2CH_2O)_b(CH_2CH_2O)_cH \quad (II)$$

present in the photographic material wherein Y represents the radical obtained upon eliminating x active hydrogens from an organic compound selected from the group consisting of monohydroxy compounds, polyhydroxy compounds, monocarboxylic acids, polycarboxylic acids, thiols and amines, wherein said monohydroxy compounds are represented by the formula $R_1OH$, said polyhydroxy compounds are represented by the formula $R_1(OH)_z$, said monocarboxylic acids are represented by the formula $R_1COOH$, said polycarboxylic acids are represented by the formula $R_1(COOH)_z$, said thiol compounds are represented by the formula $R_1SH$ and said amines are represented by the formula $R_1NH_2$, wherein $R_1$ is an alkyl group having 1 to 20 carbon atoms, an aryl group having 6 to 20 carbon atoms, an aralkyl group having 1 to 20 carbon atoms in the alkyl moiety and 6 to 20 carbon atoms in the aryl moiety, and z is 2 or 3; R represents a hydrogen atom or an alkyl group containing 1 to 18 carbon atoms; m is an integer of from 5 to 50; n is an integer of from 10 to 100; b is an integer of from 8 to 50; a + c ranges from 5 to 100; and the polyoxyethylene moieties therein comprise about 10 to about 70% by weight of the total weight of the copolymer; and x represents an integer of from 1 to 3.

9. The silver halide photographic material of claim 8, wherein the amount of said copolymer represented by the general formulae (I) and (II) ranges from about 0.0005 to about 2 g per mole of silver in said silver halide photographic material.

10. The silver halide photographic material of claim 8, wherein said block copolymer has the general formula (II).

11. The silver halide photographic material of claim 8, wherein m is an integer of from 10 to 40, n is an integer of from 15 to 70, b is an integer of from 14 to 40, the sum of a and c is an integer of from 5 to 70 and said polyoxyethylene moieties contained therein comprise 20 to 60% by weight of said block copolymer.

* * * * *